US008376481B2

(12) United States Patent
Lee

(10) Patent No.: US 8,376,481 B2
(45) Date of Patent: Feb. 19, 2013

(54) REFRIGERATOR AND RAIL ASSEMBLY OF REFRIGERATOR AND REFRIGERATOR DOOR ALIGNMENT METHOD

(75) Inventor: Chang Lim Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 106 days.

(21) Appl. No.: 12/741,224

(22) PCT Filed: Nov. 5, 2008

(86) PCT No.: PCT/KR2008/006515

§ 371 (c)(1),
(2), (4) Date: May 4, 2010

(87) PCT Pub. No.: WO2009/061127

PCT Pub. Date: May 14, 2009

(65) Prior Publication Data

US 2010/0263402 A1 Oct. 21, 2010

(30) Foreign Application Priority Data

Nov. 5, 2007 (KR) ..... 10-2007-0112244

(51) Int. Cl.
*A47B 96/00* (2006.01)
*A47B 88/00* (2006.01)

(52) U.S. Cl. ..... 312/402; 312/334.44; 312/331

(58) Field of Classification Search ..... 312/331, 312/334.7, 334.8, 402, 404, 408, 333, 334.44, 312/334.46

See application file for complete search history.

(56) References Cited

U.S. PATENT DOCUMENTS 1,231,291 A * 6/1917 Otte ..... 312/334.8
3,033,639 A * 5/1962 Emery ..... 312/334.29
3,059,986 A * 10/1962 Miller, Jr. ..... 312/334.8
4,440,461 A * 4/1984 Powell et al. ..... 312/334.8
4,615,570 A * 10/1986 Goodman ..... 312/110

(Continued)

FOREIGN PATENT DOCUMENTS

JP 5346286 A 12/1993
KR 10-2003-0079522 A 10/2003

(Continued)

OTHER PUBLICATIONS

International Search Report dated Jun. 25, 2009 for Application No. PCT/KR2008/006515, 2 pages.
Korean Notice of Allowance dated May 19, 2009 for Application No. 10-2007-0112244, with English translation 5 pages.

*Primary Examiner* — James O Hansen
*Assistant Examiner* — Matthew Ing
(74) *Attorney, Agent, or Firm* — Fish & Richardson P.C.

(57) ABSTRACT

Provided is a rail assembly of a refrigerator. The rail assembly includes a pair of extendable rails, a rack, pinions, and restricting units. The rails are disposed at left and right sides of an inner wall of a storage space. The rack is disposed under the rails. The rack includes teeth continuously formed in a length direction of the rails and a flat alignment part disposed at a front side of the rack. The pinions are respectively disposed at the rails and movable in mesh with the teeth of the rack. The restricting units are disposed at sides of the rails for restricting a movement of the rails when the rails are extended, so as to prevent the pinions from departing from the rack. When the rails are maximally extended, the pinions are placed at the alignment part.

14 Claims, 4 Drawing Sheets

U.S. PATENT DOCUMENTS

| | | | | |
|---|---|---|---|---|
| 5,722,750 | A * | 3/1998 | Chu | 312/334.11 |
| 6,382,751 | B1 * | 5/2002 | Chiu | 312/334.11 |
| 2003/0209959 | A1 * | 11/2003 | Shih-Long et al. | 312/334.46 |
| 2004/0183415 | A1 * | 9/2004 | Kim | 312/402 |
| 2005/0093406 | A1 * | 5/2005 | Yang | 312/333 |
| 2005/0160854 | A1 * | 7/2005 | Rotter | 74/422 |
| 2006/0066190 | A1 * | 3/2006 | Hay | 312/333 |
| 2006/0091771 | A1 * | 5/2006 | Teskey | 312/334.44 |

FOREIGN PATENT DOCUMENTS

| | | | |
|---|---|---|---|
| KR | 102003079522 | A | 10/2003 |
| KR | 20-0333789 | Y1 | 11/2003 |
| KR | 10-2006-0053420 | A | 5/2006 |
| KR | 10-2007-008046 | A | 1/2007 |
| WO | WO2007/007950 | * | 1/2007 |
| WO | WO2007007950 | A1 | 1/2007 |

* cited by examiner

[Fig. 1]
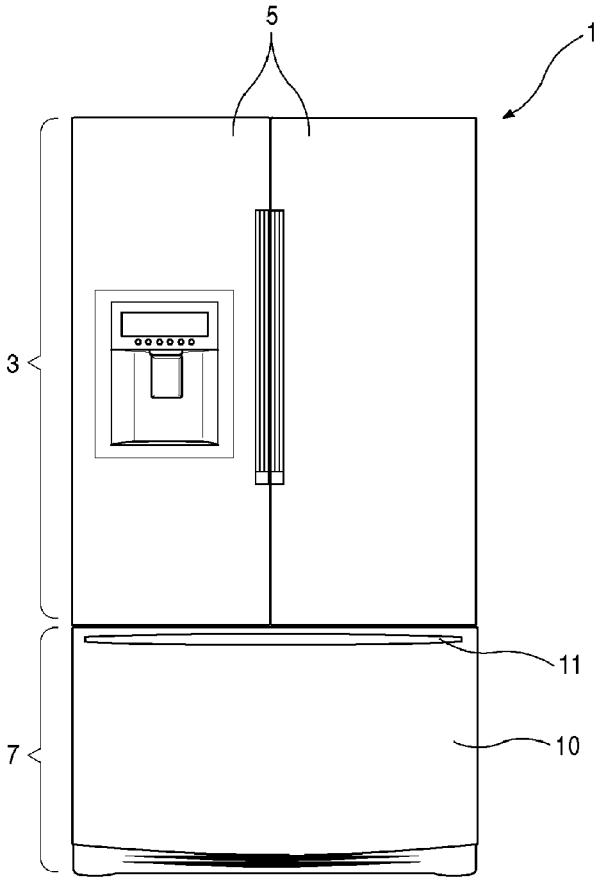
[Fig. 2]
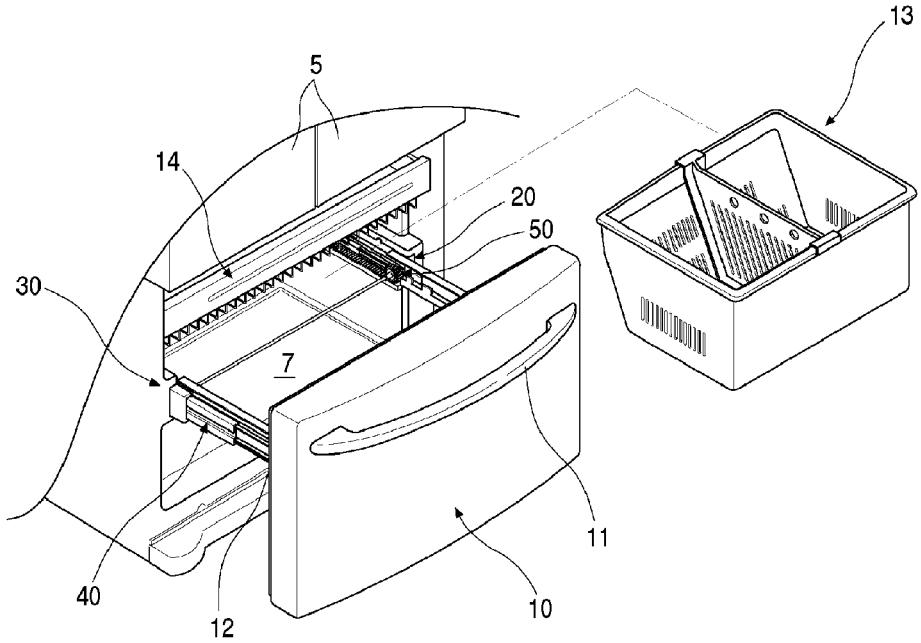

[Fig. 3]
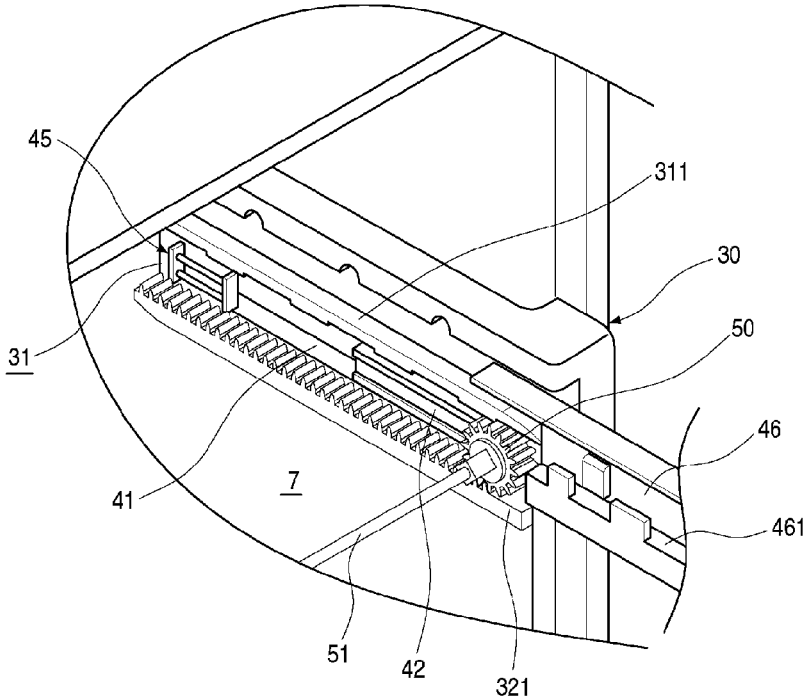
[Fig. 4]
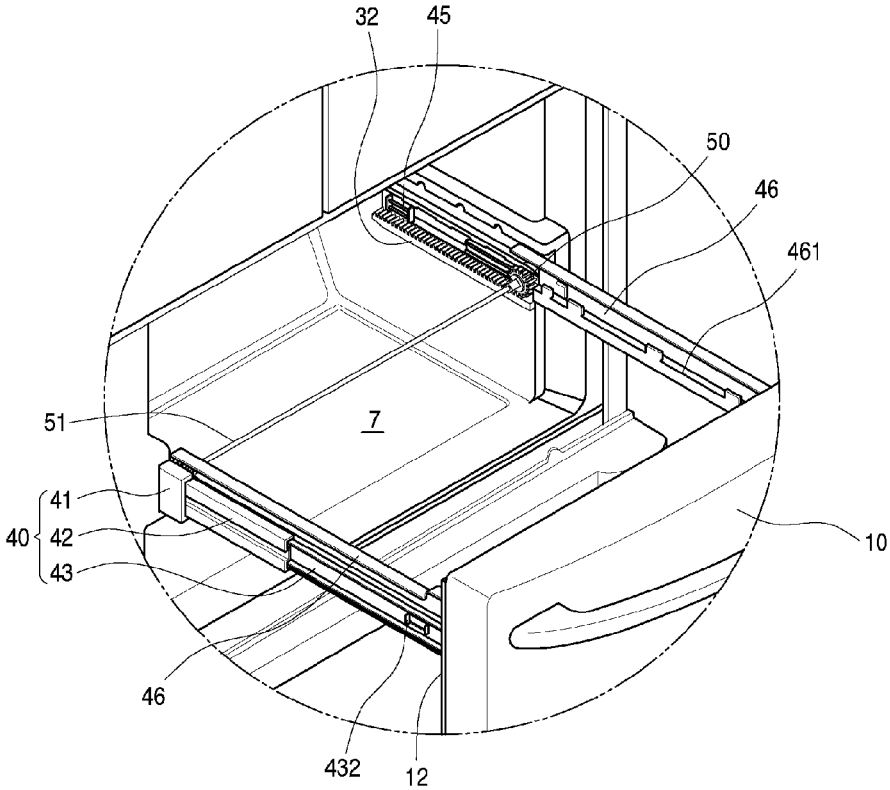

[Fig. 5]
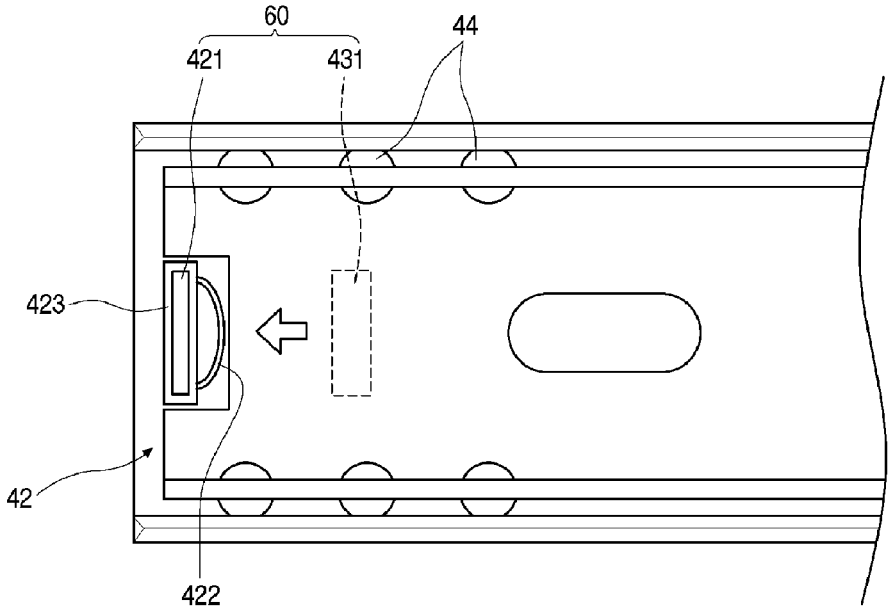
[Fig. 6]
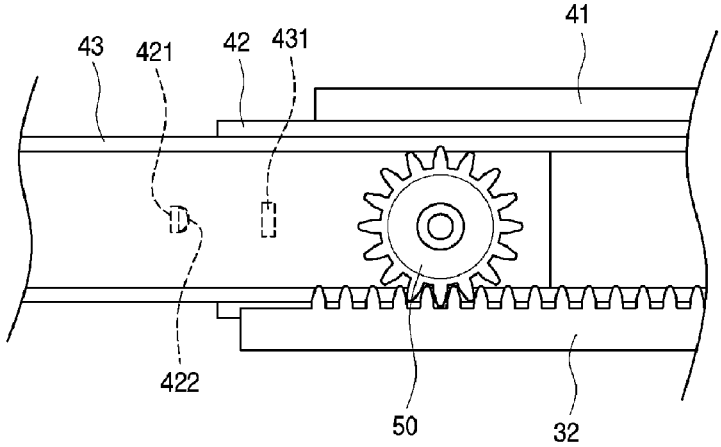
[Fig. 7]
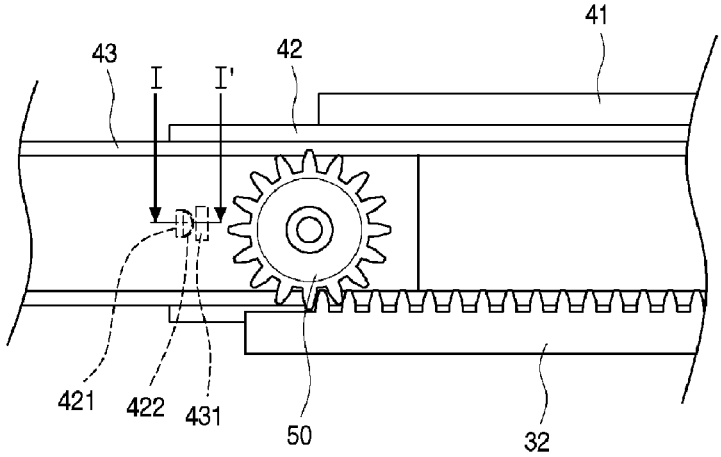

[Fig. 8]
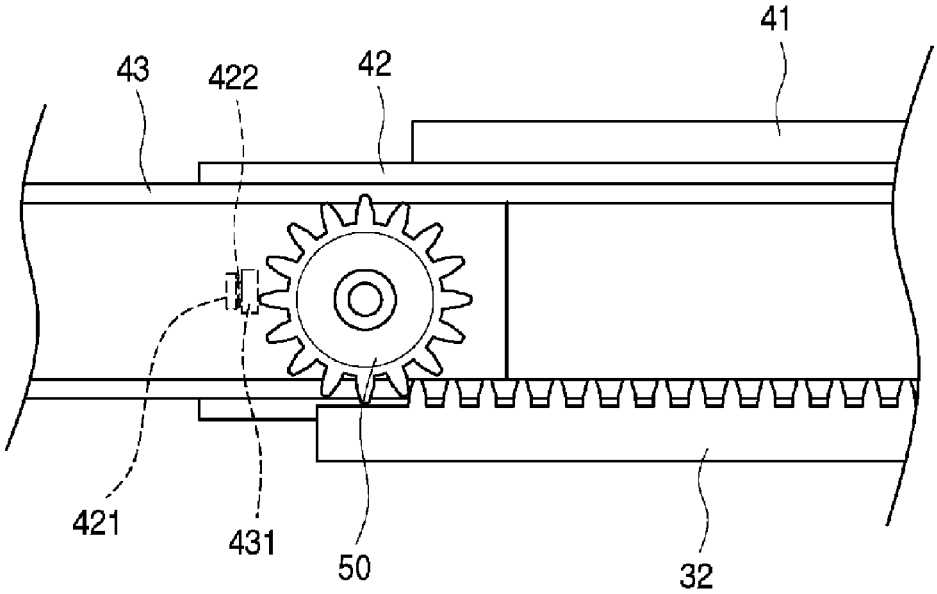
[Fig. 9]
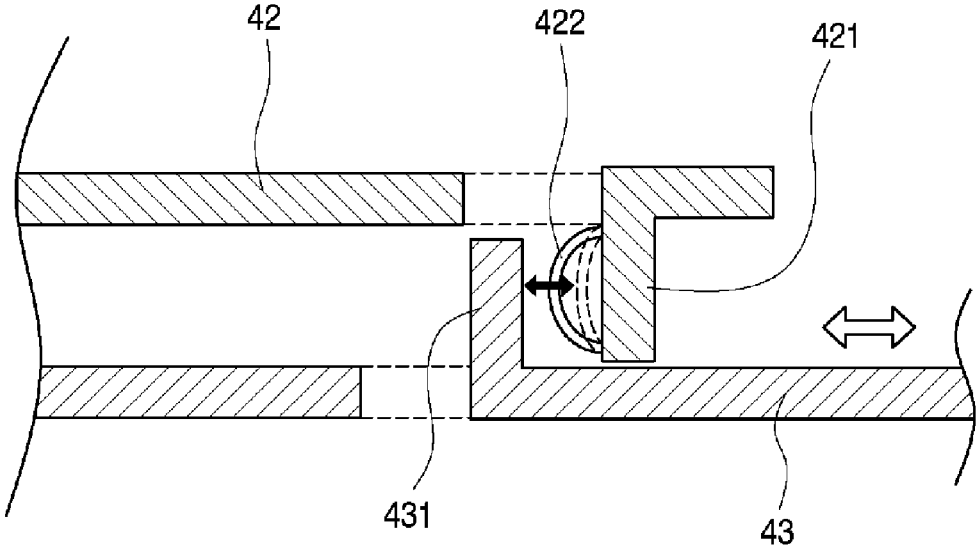

REFRIGERATOR AND RAIL ASSEMBLY OF REFRIGERATOR AND REFRIGERATOR DOOR ALIGNMENT METHOD

TECHNICAL FIELD

The present disclosure relates to a refrigerator, a rail assembly of a refrigerator, and a refrigerator door alignment method.

BACKGROUND ART

Generally, refrigerators are used to store foods in a storage space closed by a refrigerator door at a low temperature. For this, air cooled through heat exchange with a refrigerant in refrigeration cycles is used to cool the storage space for keeping foods stored in the storage space at an optimal state.

With changes in eating habits and advances in technology, large and multifunctional refrigerators have been introduced, and various structures and convenient devices have been included in the refrigerators for the convenience of customers.

Such a refrigerator includes at least one storage space. For example, a refrigerator may include a plurality of storage spaces such as a freezer compartment and a refrigerator compartment. The freezer compartment and refrigerator compartment are configured to be closed and opened by doors.

Rotatable or slidable doors are widely used as refrigerator doors. Generally, in a bottom freezer type refrigerator in which a freezer compartment is located under a refrigerator compartment, a forward/backward sliding door is used to close and open the lower freezer compartment, and a basket used to store foods is configured to be slid forward/backward together with the sliding door. For this, rail assemblies are provided on both sides of a storage space of the refrigerator for supporting the door and the basket and allowing sliding of the door and the basket.

The door and the basket have a relatively large transverse width to cover the opened front side of the freezer compartment, and the weights of the door and the basket are relatively great. Therefore, when the door is moved in/out, the door and the basket undesirably swing left and right.

For this reason, racks and pinions are included in the rail assemblies so that when the rail assemblies are slid in/out for closing and opening the door, the pinions move along the racks to prevent swinging motions of the door.

Structures for aligning the teeth of a pinion and a rack when a door is initially assembled or slid in/out are disclosed in Korean Patent Nos. 10-0634361 and 10-0659664, and Korean Patent Application Publication No. 10-2007-0008046.

In the disclosed Patents, a structure is provided at a side of a rack for aligning a pinion and properly coupling the pinion with a rack when a door is initially assembled. However, when the door is initially assembled or retracted after being maximally extended, an excessive force can be applied to one of both sides of the door, or the rack and pinion can be misaligned due to improper handling of the door.

Therefore, in this case, although the door is completely retracted, one side of the door is not completely in contact with a frame of a freezer compartment, and thus cooling air is dissipated through a gap between the door and the frame of the freezer compartment.

DISCLOSURE OF INVENTION

Technical Problem

Embodiments provide a refrigerator in which a restricting member restricts an extending motion of a rail including a pinion and a rack. When the rail is maximally extended, the pinion is disengaged from the rack at an alignment part formed at a front end portion of the rack so that a door of the refrigerator can be aligned.

Embodiments also provide a rail assembly of a refrigerator for extending and retracting a door of the refrigerator. The rail assembly includes a rail, a pinion, a rack, an alignment part disposed at a side of the rack, and a restricting member disposed at a side of the rail, so that when the rail is maximally extended, detachment of the rail can be prevented and the rail can be aligned.

Embodiments also provides a refrigerator door alignment method for restricting extending of a door using a stopper of a rail after the door is maximally extended, and for aligning the door by aligning a pinion at an alignment part of a rack when the door is maximally extended and engaging the pinion with teeth of the rack using an elastic force of an elastic member when the door is retracted.

Technical Solution

In one embodiment, a rail assembly of a refrigerator includes: a pair of extendable rails at left and right sides of an inner wall of a storage space; a rack under the rails, the rack including teeth continuously formed in a length direction of the rails and a flat alignment part disposed at a front side of the rack; pinions respectively disposed at the rails and movable in mesh with the teeth of the rack; and restricting units disposed at sides of the rails for restricting a movement of the rails when the rails are extended, so as to prevent the pinions from departing from the rack, wherein when the rails are maximally extended, the pinions are placed at the alignment part.

In another embodiment, a refrigerator includes: a main body forming at least one storage space; a door configured to selectively close the storage space; rails at left and right sides of an inner wall of the storage space, the rails being extendable in multiple steps for allowing the door to be extended and retracted by sliding; pinions rotatably disposed at the rails, respectively; a rack disposed under the rails for guiding a movement of the pinions; restricting units disposed at sides of the rails for interfering with each other when the rails are maximally extended, so as to prevent the pinions from departing from the rack; and an alignment part extending from a front end portion of the rack so that when the rails are maximally extended, a gear coupling between the rack and the pinions are released at the alignment part.

In further another embodiment, a refrigerator door alignment method includes: gripping a door handle for opening a door; pulling the door so as to move pinions along a rack and place the pinions at an alignment part at which the pinions are disengaged from the rack, wherein the pinions are disposed at a rail configured to guide a sliding motion of the door for extending and retracting of the door, and the rack is disposed under the rail; further extending the rail when the pinions are placed at the alignment part so as to compress an elastic member disposed at a restricting unit configured to restrict extending and retracting of the rail; removing an opening force applied to the door so that the pinions are engaged with teeth of the rack in an aligned state by a resilient force exerted by the compressed elastic member; and closing the door by retracting the door in the state where the pinion is aligned with the teeth of the rack.

The details of one or more embodiments are set forth in the accompanying drawings and the description below. Other features will be apparent from the description and drawings, and from the claims.

Advantageous Effects

According to the present disclosure, the door can be extended and retracted without swinging motions owing to the pinion and the rack, and the pinion can be placed at the alignment part formed at the front end portion of the rack owing to the restricting unit provided at the rail so that the horizontal position of the door can be re-aligned when the door is maximally opened.

Furthermore, owing to the elastic member provided at the restricting unit, impacts acting on the door can be reduced when the door is opened, so that customers can use products conveniently.

Furthermore, the pinions can be simultaneously coupled to the racks owing to the elastic members, so that the horizontal position of the door can be re-aligned more stably and reliably.

In addition, the elastic members restrain the pinions from departing from the racks. Therefore, after the door is once aligned, the door can be conveniently used since the elastic members maintain the aligned state of the door by restraining the pinions from departing from the racks.

Therefore, the door can be aligned more easily, and thus uses can use the door more conveniently.

BRIEF DESCRIPTION OF THE DRAWINGS

FIG. 1 is a front view illustrating a refrigerator according to an embodiment.

FIG. 2 is a perspective view illustrating a detached basket according to an embodiment.

FIG. 3 is a partial perspective view illustrating an installed state of the rail assembly according to an embodiment.

FIG. 4 is a partial perspective view illustrating the rail assembly according to an embodiment.

FIG. 5 is a plan view illustrating a restricting unit and an elastic member of the rail assembly according to an embodiment.

FIGS. 6 to 8 are schematic views illustrating extending of the rail assembly according to an embodiment.

FIG. 9 is a sectional view illustrating the elastic member when the rail assembly is extended according to an embodiment.

BEST MODE FOR CARRYING OUT THE INVENTION

Reference will now be made in detail to the embodiments of the present disclosure, examples of which are illustrated in the accompanying drawings. The present disclosure may, however, be embodied in many different forms and should not be construed as being limited to the embodiments set forth herein.

A refrigerator, a rail assembly of a refrigerator, and a refrigerator door alignment method of the present disclosure can be applied to various types of refrigerators including a door that can be extended and retracted like a drawer. In the following description, a bottom freezer type refrigerator will be explained as an example.

FIG. 1 is a front view illustrating a refrigerator 1 according to an embodiment, and FIG. 2 is a perspective view illustrating a detached basket 13 according to an embodiment.

Referring to FIGS. 1 and 2, the refrigerator 1 includes a hexahedral main body forming the exterior of the refrigerator 1, and a storage space is formed in the main body for storing foods. The storage space of the main body is divided into an upper refrigerator compartment 3 and a lower freezer compartment 7.

An opened front side of the refrigerator compartment 3 is closed by a pair of doors 5, and the doors 5 are hinged on both sides of the main body so that the doors 5 can be rotated left and right for selectively opening and closing the refrigerator compartment 3.

If necessary, a dispenser can be provided at the doors 5 of the refrigerator compartment 3 to dispense water and ice, and a home bar can be provided at the door 5 to allow convenient access to foods stored in the refrigerator compartment 3.

An opened front side of the freezer compartment 7 is closed by a door 10. The door 10 has a shape corresponding to the shape of the freezer compartment 7 so that the door 10 can cover the entire front side of the freezer compartment 7. A handle 11 is provided at a front upper side of the door 10 so that a user can extend and retract the door 10 using the handle 11. A gasket 12 is provided along the periphery of a rear side of the door 10 for insulating and sealing the freezer compartment 7.

The door 10 can be extended and retracted in forward and backward directions like a drawer. For this, rail assemblies (described later in detail) including rails 40, racks 32 (refer to FIG. 4), and pinions 50 are provided in the freezer compartment 7. Therefore, the freezer compartment 7 can be selectively closed and opened by the forwardly extendable door 10. Furthermore, a lower end of the door 10 is hinged so that the door 10 can be forwardly tilted at a predetermined angle (this hinged structure is not shown). Owing this hinged structure, foods can be put into and taken from the freezer compartment 7 more easily.

The rails 40 are disposed on both sides of the freezer compartment 7, and rail covers 46 (refer to FIG. 3) are provided for the rails 40. The basket 13 is placed on the rail covers 46 for receiving foods. Therefore, when the door 10 is extended/retracted, the basket 13 can be extended/retracted together with the door 10.

A second basket 14 is disposed above the basket 13. That is, the second basket 14 is disposed at an upper side of the freezer compartment 7. The second basket 14 is composed of bent wires and has a drawer shape. The second basket 14 can be individually extended and retracted in the forward and backward directions.

Rail housings 30 are disposed at inner left and right walls of the freezer compartment 7. The rail housings 30 are provided to fix the rails 40 to the inner walls of the freezer compartment 7. For this, sides of the rail housings 30 are fixed to the inner walls of the freezer compartment 7, and the other sides of the rail housings 30 accommodate the rails 40.

The rails 40 and the rail housings 30 provided for installation of the rails 40 will now be described in more detail with reference to the accompanying drawings.

FIG. 3 is a partial perspective view illustrating an installed state of the rail assembly according to an embodiment, and FIG. 4 is a partial perspective view illustrating the rail assembly according to an embodiment.

Referring to FIGS. 3 and 4, the rail housings 30 are disposed at left and right inner sides of the freezer compartment 7 and have an elongated shape extending from a stepped front side to a rear side of the freezer compartment 7. The rail housings 30 may be fixed to the inner walls of the freezer compartment 7 via coupling members such as screws or brackets previously mounted on the inner walls of the freezer compartment 7.

Channels 31 are formed in the rail housings 30. The channels 31 are provided for installing the rails 40 and located at mutually facing sides of the rail housings 30. The channels 31 are configured to make contact with top, bottom, and lateral surfaces of the rails 40 and have an opened inner side so that the rails 40 can be inserted into the channels 31 from the front side of the freezer compartment 7.

The racks 32 are disposed under the rail housings 30. The racks 32 are provided for relative motions with the pinions 50 (described later in detail). The racks 32 have an elongated shape extending from the front to the rear sides of the rail housings 30.

Front ends of the racks 32 slightly protrude forward from a recessed surface of the stepped front side of the freezer compartment 7. In addition, the front ends of the racks 32 protrude more than front portions of the rail housings 30.

Teeth are formed at the top surfaces of the racks 32. The teeth of the racks 32 correspond to teeth of the pinions 50 so that the pinions 50 can move on the racks 32 in mesh with the racks 32. The teeth of the racks 32 are pointed upward and protruded to the opened sides of the channels 31. Thus, the teeth of the racks 32 can confine the rails 40 in the channels 31 together with detachment preventing parts 311 disposed at upper ends of the opened sides of the channels 31. Therefore, the rails 40 cannot be detached through the opened sides of the channels 31.

The teeth of the racks 32 are continuously formed from rear ends of the racks 32 toward front sides of the racks 32, and alignment parts 321 are formed at the front ends of the racks 32. At the alignment parts 321 of the racks 32, teeth are not formed. The alignment parts 321 are toothless flat parts formed at top surfaces of the racks 32 so that the pinions 50 can be freely rotated on the alignment parts 321.

The alignment parts 321 have a length corresponding to three to five teeth of the racks 32. That is, the alignment parts 321 have a length corresponding to the diameter of the pinions 50. The alignment parts 321 have the same height as the root of the teeth of the racks 32 so that the pinions 50 can be disengaged from the teeth of the racks 32 at the alignment parts 321.

The alignment parts 321 are located such that when the rails 40 are maximally extended, the pinions 50 are placed at the alignment parts 321. That is, the alignment parts 321 are located at the front ends of the rail housings 30.

Alternatively, the entire top surfaces of the racks 32 may be formed with teeth. In this case, the alignment parts 321 may be formed at positions extending forward from the front ends of the racks 32.

The rack 32 and the rail housing 30 may be formed in one piece through an injection molding process, or the rack 32 may be separately formed and coupled to the rail housing 30. Alternatively, the rack 32 may not be coupled to the rail housing 30 but be independently provided at an inner side of the freezer compartment 7.

The rails 40 can be provided at both inner sides of the freezer compartment 7 by inserting the rails 40 into the rail housings 30. The rails 40 can be extended and retracted in steps to move the door 10 and the basket 13 forward and backward.

In more detail, each of the rails 40 includes a fixed rail 41, a guide rail 42, and a movable rail 43. The fixed rail 41, the guide rail 42, and the movable rail 43 have the same structures as those used for a related-art drawer type door of a refrigerator and are sequentially overlapped. Bearings 44 (refer to FIG. 5) provided for rolling and sliding motions of the fixed rail 41, the guide rail 42, and the movable rail 43.

The fixed rail 41 is accommodated inside the rail housing 30 and is fixed to the inside of the channel 31 by snap fitting so that the rail 40 can be mounted and fixed through the fixed rail 41. An auto closing unit 45 is disposed at an inner rear side of the fixed rail 41 so that when the rail 40 is retracted, the guide rail 42 and the movable rail 43 can be pulled by a spring force of the auto closing unit 45 for closing the door 10 automatically. The auto closing unit 45 is well-known and widely used for a rail member. Thus, a detailed description of the auto closing unit 45 will be omitted.

The guide rail 42 is disposed at an inner side of the fixed rail 41. The guide rail 42 can be moved forward and backward relative to the fixed rail 41. The movable rail 43 is disposed at an inner side of the guide rail 42. The movable rail 43 can moved forward and backward relative to the guide rail 42.

The rail cover 46 is disposed at the movable rail 43 for receiving the basket 13. The rail cover 46 has a length corresponding to the length of the movable rail 43 to cover the movable rail 43. Receiving parts each having a concave-convex shape are formed at corresponding inner sides of the left and right rail covers 46 for receiving the basket 13.

The rail cover 46 is inserted in an installing part 432 formed at the movable rail 43 and fixed to the movable rail 43 using a screw so that the rail cover 46 is extended and retracted together with the movable rail 43. A front end of the movable rail 43 is connected to a door frame 15 that supports the door 10 or the freezer compartment 7 so that the movable rail 43 can be extended and retracted together with the door 10. Since the basket 13 is received on the rail cover 46, the basket 13 can be moved forward and backward together with the movable rail 43.

The pinions 50 are disposed at inner rear sides of the movable rails 43. The pinions 50 are meshed with the racks 32 so that when the rails 40 are slid, the pinions 50 move relative to the racks 32. A shaft 51 connects rotation centers of the pinions 50 disposed at the inner rear sides of the left and right movable rails 43. Therefore, the left and right pinions 50 are simultaneously rotated at the rear sides of the movable rails 43 when the door 10 is closed or opened.

When the door 10 is closed, the pinions 50 are placed on the racks 32 at rearmost positions, and when the door 10 is opened, the pinions 50 are rotated on the racks 32 toward front sides of the racks 32. Particularly, when the door 10 is completely opened (that is, when the rails 40 are maximally extended), the pinions 50 are placed at the alignment parts 321 where the pinions 50 can be freely rotated to align the door 10 without inclination.

A restricting unit 60 (refer to FIG. 5) is disposed at the rail 40 for limiting the extending motion of the door 10. The restricting unit 60 restricts the extending motion of the rail 40 so that the pinion 50 is not departed from the alignment part 321 when the rail 40 is maximally extended. This restricting by the restricting unit 60 is accomplished by a contact between the guide rail 42 and the movable rail 43.

In more detail, the restricting unit 60 includes a first restricting part 421 (refer to FIG. 5) and a second restricting part 431 (refer to FIG. 5).

The first restricting part 421 protrudes vertically and inwardly from a position close to a front end of the guide rail 42. The first restricting part 421 may be formed by cutting a portion of the guide rail 42 close to the front end of the guide rail 42 in to a C-shape and bending the remaining portion inwardly and vertically. Alternatively, the first restricting part 421 can be formed by attaching a separate protruded part to the guide rail 42. Besides, the first restricting part 421 can be formed in various shapes and manners.

The second restricting part 431 is disposed at a rear outer side of the movable rail 43. The second restricting part 431 makes contact with the first restricting part 421 when the movable rail 43 is completely extended. In detail, when the movable rail 43 is maximally extended such that the pinion 50 tends to depart from the alignment part 321, the second restricting part 431 makes contact with the first restricting part 421 to prevent a further extending of the movable rail 43.

The second restricting part 431 is located behind the first restricting part 421 and protrudes outward and vertically so that the second restricting part 431 can make contact with the first restricting part 421 when the movable rail 43 is slid outward. The second restricting part 431 may have the same shape as that of the first restricting part 421. The first restricting part 421 and the second restricting part 431 may be bent in mutually facing directions. That is, the first restricting part 421 and the second restricting part 431 may protrude in mutually facing directions to restrict the extending motion of the movable rail 43 by interference between the first restricting part 421 and the second restricting part 431.

An elastic member 422 is provided at the restricting unit 60 to absorb impacts when the rail 40 is maximally extended and engage the pinion 50 with the rack 32 in an aligned position.

As described above, the rail 40 is configured by the fixed rail 41, the guide rail 42, and the movable rail 43 so as to be extended in two steps. Alternatively, the rail 40 may be configured by the fixed rail 41 and the movable rail 43 without the guide rail 42. Alternatively, the rail 40 may be configured by the fixed rail 41, the movable rail 43, and at least one additional slidable rail disposed inside the movable rail 43. Besides, the rail 40 can be various configurations as long as the rail 40 provides a slidable extending structure.

FIG. 5 is a plan view illustrating the restricting unit 60 and the elastic member 422 of the rail assembly according to an embodiment. The restricting unit 60 and the elastic member 422 will now be described in more detail with reference to FIG. 5.

The elastic member 422 is disposed at the first restricting part 421 of the restricting unit 60 provided at the guide rail 42. The elastic member 422 is disposed at the right side (viewed from FIG. 5) of the first restricting part 421 that is configured to make contact with the second restricting part 431.

The elastic member 422 is composed of a plate spring and rounded toward the second restricting part 431. Both sides of the elastic member 422 are fixed to the right side of the first restricting part 421. Therefore, as the second restricting part 431 moves toward the first restricting part 421 together with the movable rail 43, one side of the second restricting part 431 presses the elastic member 422 so that the elastic member 422 is compressed.

At the moment the rounded end portion of the elastic member 422 makes contact with the second restricting part 431, the pinion 50 is placed between the alignment part 321 and the teeth of the rack 32.

Therefore, when the pinion 50 is completely placed at the alignment part 321, the elastic member 422 is in a compressed state so that the pinion 50 tends to engage with the teeth of the rack 32 by the resilient force of the elastic member 422.

To easily install the elastic member 422 at the first restricting part 421, the elastic member 422 may be formed in one piece with an installing member 423 inserted in the first restricting part 421. Alternatively, the elastic member 422 may be installed at the second restricting part 431. That is, the elastic member 422 can be disposed at any position between the first restricting part 421 and the second restricting part 431 as long as the elastic member 422 applies an elastic force when the pinion 50 is placed at the alignment part 321. Instead of forming the elastic member 422 in a plate spring shape, the elastic member 422 may be formed in a compression spring shape, or the elastic member 422 may be formed of other elastic members.

FIGS. 6 to 8 are schematic views illustrating extending of the rail assembly according to an embodiment, and FIG. 9 is a sectional view illustrating the elastic member 422 when the rail assembly is extended according to an embodiment.

Hereinafter, extending/retracting of the above-described door 10, and a method of aligning the door 10 will be explained with reference to the accompanying drawings.

When the door 10 is completely closed, the rails 40 are retracted to the shortest length, and the pinions 50 are placed at rear sides of the racks 32. If it is necessary to align the door 10 in this state, the door 10 can be aligned after opening the door 10 using the handle 11 (S100).

If the door 10 is pulled forwardly in this state, the door 10 is moved forwardly together with the basket 13 as the rails 40 are slid and extended. As the rails 40 are extended, the pinions 50 fixed to the rails 40 are rotated on the racks 32 and moved forward.

FIG. 6 illustrates a state where the door 10 is partially opened. The pinions 50 fixed to the rear end portions of the movable rails 43 are rotatably meshed with the teeth of the racks 32.

Since the pinions 50 connected through the shaft 51 move along the racks 32 in mesh with the racks 32, the door 10 can be pulled with left and right sides of the door 10 being balanced. As the door 10 is moved forward, the first restricting parts 421 disposed at the guide rails 42 approach the second restricting parts 431 disposed at the movable rails 43.

If the door 10 is further pulled and thus the rails 40 are further extended, the rails 40 are maximally extended, and the door 10 is completely opened. In this state, the basket 13 is fully exposed to the outside so that foods can be easily placed into or taken from the basket 13.

FIG. 7 illustrates a state just before the door 10 is maximally opened. The pinions 50 provided at the movable rails 43 are placed between the last teeth and the alignment parts 321 of the racks 32. In this state, the first restricting parts 421 of the guide rails 42 are placed close to the second restricting parts 431 of the movable rails 43, and the rounded elastic members 422 protruded from the first restricting parts 421 make contact with the second restricting parts 431 (S200).

In this state, if the door 10 is further opened, the elastic members 422 are compressed, and when the door 10 is completely opened, the rails 40 are maximally extended.

FIG. 8 illustrates a state where the door 10 is maximally opened. The pinions 50 provided at the movable rails 43 are placed at the alignment parts 321 of the racks 32. In this state, since the pinions 50 are disengaged from the racks 32 and freely rotatable, the door 10 can be aligned.

In this state, the movable rails 43 cannot be further extended owing to the interference between the first restricting parts 421 and the second restricting parts 431, and thus the pinions 50 are not departed from the alignment parts 321 away from the racks 32 (S300).

When the rails 40 are maximally extended, the elastic members 422 are maximally compressed. In this state, if a force applied to pull the door 10 is reduced or removed, the second restricting parts 431 of the movable rails 43 is pushed backward by the resilient forces of the elastic members 422 as shown in FIG. 9.

As the second restricting parts 431 are pushed backward, the movable rails 43 are retracted, and thus the pinions 50 placed at the alignment parts 321 are engaged with the teeth of the racks 32. At this time, the pinions 50 placed at the alignment parts 321 in a freely rotatable state are simultaneously engaged with the teeth of the racks 32 by the uniform resilient forces of the elastic members 422 so that the pinions 50 can be coupled with the teeth of the racks 32 along the same extension line without misalignment (S400).

That is, although the horizontal position of the door 10 is misaligned when the door 10 is initially installed or while the door 10 is used, the horizontal position of the door 10 can be properly re-aligned by opening the door 10 completely and coupling the pinions 50 to the racks 32 using the resilient forces of the elastic members 422, so that when the door 10 is closed again, the rear periphery of the door 10 can be in close contact with the front side of the freezer compartment 7 (S500).

Furthermore, the elastic members 422 reduce impacts applied to the rails 40 and the door 10 when the door 10 is completely opened, and unless the door 10 is forcibly opened after the door 10 is aligned, the engagement between the pinions 50 and the teeth of the racks 32 can be maintained owing to the elastic members 422 while the door 10 is extended and extracted.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the present disclosure, the door can be extended and retracted without swinging motions owing to the pinions and the racks, and the pinions can be simultaneously coupled to the racks owing to the elastic members so that the horizontal position of the door can be aligned more stably and reliably.

Therefore, owing to the improved extending, retracting, and aligning structures of the door, users can be satisfied much more. Therefore, the industrial applicability of the refrigerator, the rail assembly, and the refrigerator door alignment method is very high.

The invention claimed is:

1. A refrigerator comprising:

a main body forming at least one storage space;

a door configured to selectively close the storage space;

a handle disposed at the door and configured to enable a user to extend and retract the door;

rails at left and right sides of an inner wall of the storage space, the rails being extendable in multiple steps for allowing the door to be drawn in and out by sliding;

a pair of pinions rotatably disposed at the rails, respectively;

a rack disposed under the rails for guiding a movement of the pinions;

an alignment part extending from a front end portion of the rack so that when the rails are maximally extended, a gear coupling between the rack and the pinions are released at the alignment part;

a first restriction part inwardly protruded at a side of one of the rails;

a second restriction part outwardly protruded at a side of the other one of the rails and being configured to restrict movement of the rails when the rails are extended to a position that causes interference between the first restriction part and the second restriction part; and an elastic member disposed at the second restriction part, the elastic member configured to be elastically deformed by the first restriction part when the rails are maximally extended and the pinions are placed at the alignment part, wherein when the user pulls the handle to maximally extend the rails, the elastic member is deformed and the pinions are placed at the alignment part, and wherein when the user releases the handle at a point of maximum extension of the rails, the elastic member applies a resilient force to retract the rails such that the pair of pinions simultaneously engage teeth of the rack and the door is automatically aligned, wherein the elastic member protrudes from the second restriction part and makes contact with the first restriction part when the pinions partially overlap both the rack and the alignment part;

wherein, when the rails are further extended to a maximally extended position, the elastic member is compressed to a maximally compressed state and the pinions are placed at the alignment part where they are disengaged from the rack and freely rotatable; and wherein, when a force applied to pull the door to the maximally extended position is removed, the rails are pushed back by resilient force of the elastic member and engage with the teeth of the rack.

2. The refrigerator according to claim 1, wherein teeth corresponding to teeth of the pinions are continuously arranged on a top surface of the rack from a rear end of the rack to the alignment part, and the alignment part has a flat shape.

3. The refrigerator according to claim 1, wherein the rails comprise:

fixed rails fixed to both inner corresponding walls of the main body;

guide rails slidably disposed at the fixed rails; and movable rails slidably disposed at the guide rails, wherein the pinions are disposed at the movable rails.

4. The refrigerator according to claim 1, wherein the elastic member is formed of a plate spring having a predetermined curvature.

5. The refrigerator according to claim 1, wherein each of the rails comprises:

a fixed rail fixed to the inner wall of the storage space; and a movable rail extendable and retractable in forward and backward directions relative to the fixed rail, wherein the pinion is disposed at the movable rail.

6. The refrigerator according to claim 1, wherein a rail housing is disposed at the inner wall of the storage space to fix the rails to the rail housing, and the rack is disposed at the rail housing.

7. The refrigerator according to claim 6, wherein the rack and the rail housing are formed in one piece.

8. The refrigerator according to claim 1, wherein the rack is disposed at the inner wall of the storage space.

9. The refrigerator according to claim 1, wherein the alignment part has a length corresponding to a diameter of the pinions.

10. The refrigerator according to claim 1, wherein the alignment part has a top surface at the same height as a root of the pinions.

11. The refrigerator according to claim 1, wherein the pinions are configured to be rotated together by a shaft connecting rotation centers of the pinions.

12. The refrigerator according to claim 1, wherein a lower end of the door is hinged so that the door is configured to forwardly tilt at a predetermined angle.

13. The refrigerator according to claim 1, wherein, when the pinions are placed at the alignment part, the pinions are freely rotatable to align the door without inclination.

14. The refrigerator according to claim 1, wherein a front end of the rack protrudes forward from a recessed surface of a stepped front side of the storage space.

* * * * *